US009068787B1

(12) United States Patent
Jensen

(10) Patent No.: US 9,068,787 B1
(45) Date of Patent: Jun. 30, 2015

(54) SYSTEM FOR LOADING CARTRIDGES INTO A RIFLE

(71) Applicant: Kevin Duane Jensen, Canton, SD (US)

(72) Inventor: Kevin Duane Jensen, Canton, SD (US)

( * ) Notice: Subject to any disclaimer, the term of this patent is extended or adjusted under 35 U.S.C. 154(b) by 0 days.

(21) Appl. No.: 14/495,223

(22) Filed: Sep. 24, 2014

Related U.S. Application Data

(60) Provisional application No. 61/881,768, filed on Sep. 24, 2013.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
USPC ..... 42/87–89; 86/45
See application file for complete search history.

(56) References Cited

U.S. PATENT DOCUMENTS

| | | | | |
|---|---|---|---|---|
| 3,628,273 | A * | 12/1971 | Lach | 42/87 |
| 4,574,511 | A * | 3/1986 | Csongor | 42/87 |
| 6,688,504 | B1 * | 2/2004 | Kirkaldy | 224/196 |
| 6,754,987 | B1 * | 6/2004 | Cheng et al. | 42/87 |
| 7,805,874 | B2 * | 10/2010 | Tal et al. | 42/87 |

* cited by examiner

*Primary Examiner* — Reginald Tillman, Jr.
(74) *Attorney, Agent, or Firm* — Plager Schack LLP

(57) ABSTRACT

A system can be used for loading cartridges into a firearm having a magazine tube. The system includes a housing that can be configured direct cartridges into the magazine tube. A cartridge carrier is detachably coupled to the housing. The cartridge carrier is configured to receive a plurality of cartridges, which are then dispensed through the housing and into the magazine tube.

5 Claims, 5 Drawing Sheets

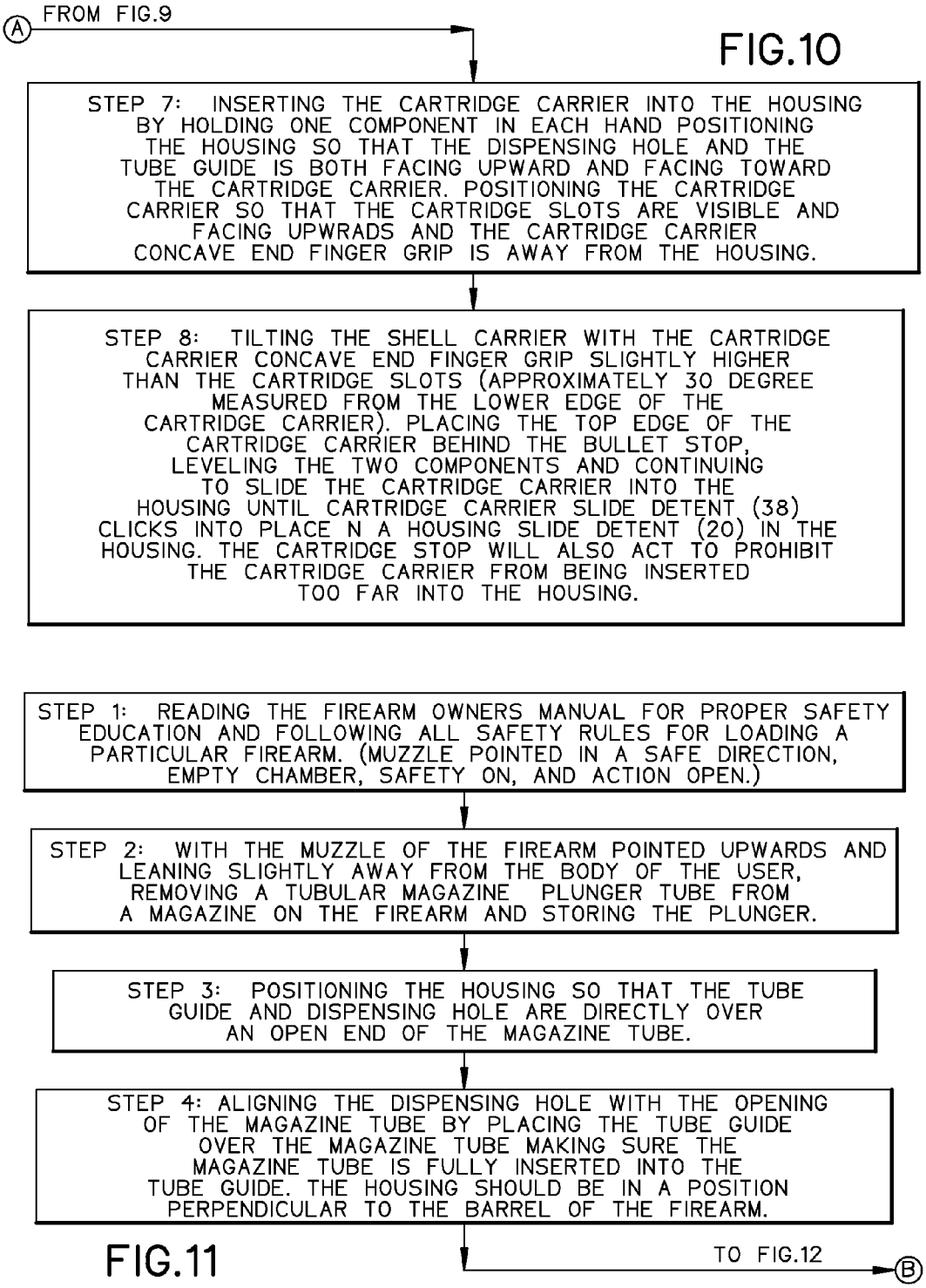
A
FROM FIG.9
FIG.10
STEP 7: INSERTING THE CARTRIDGE CARRIER INTO THE HOUSING BY HOLDING ONE COMPONENT IN EACH HAND POSITIONING THE HOUSING SO THAT THE DISPENSING HOLE AND THE TUBE GUIDE IS BOTH FACING UPWARD AND FACING TOWARD THE CARTRIDGE CARRIER. POSITIONING THE CARTRIDGE CARRIER SO THAT THE CARTRIDGE SLOTS ARE VISIBLE AND FACING UPWRADS AND THE CARTRIDGE CARRIER CONCAVE END FINGER GRIP IS AWAY FROM THE HOUSING.
STEP 8: TILTING THE SHELL CARRIER WITH THE CARTRIDGE CARRIER CONCAVE END FINGER GRIP SLIGHTLY HIGHER THAN THE CARTRIDGE SLOTS (APPROXIMATELY 30 DEGREE MEASURED FROM THE LOWER EDGE OF THE CARTRIDGE CARRIER). PLACING THE TOP EDGE OF THE CARTRIDGE CARRIER BEHIND THE BULLET STOP, LEVELING THE TWO COMPONENTS AND CONTINUING TO SLIDE THE CARTRIDGE CARRIER INTO THE HOUSING UNTIL CARTRIDGE CARRIER SLIDE DETENT (38) CLICKS INTO PLACE N A HOUSING SLIDE DETENT (20) IN THE HOUSING. THE CARTRIDGE STOP WILL ALSO ACT TO PROHIBIT THE CARTRIDGE CARRIER FROM BEING INSERTED TOO FAR INTO THE HOUSING.
STEP 1: READING THE FIREARM OWNERS MANUAL FOR PROPER SAFETY EDUCATION AND FOLLOWING ALL SAFETY RULES FOR LOADING A PARTICULAR FIREARM. (MUZZLE POINTED IN A SAFE DIRECTION, EMPTY CHAMBER, SAFETY ON, AND ACTION OPEN.)
STEP 2: WITH THE MUZZLE OF THE FIREARM POINTED UPWARDS AND LEANING SLIGHTLY AWAY FROM THE BODY OF THE USER, REMOVING A TUBULAR MAGAZINE PLUNGER TUBE FROM A MAGAZINE ON THE FIREARM AND STORING THE PLUNGER.
STEP 3: POSITIONING THE HOUSING SO THAT THE TUBE GUIDE AND DISPENSING HOLE ARE DIRECTLY OVER AN OPEN END OF THE MAGAZINE TUBE.
STEP 4: ALIGNING THE DISPENSING HOLE WITH THE OPENING OF THE MAGAZINE TUBE BY PLACING THE TUBE GUIDE OVER THE MAGAZINE TUBE MAKING SURE THE MAGAZINE TUBE IS FULLY INSERTED INTO THE TUBE GUIDE. THE HOUSING SHOULD BE IN A POSITION PERPENDICULAR TO THE BARREL OF THE FIREARM.
FIG.11
TO FIG.12
B

SYSTEM FOR LOADING CARTRIDGES INTO A RIFLE

RELATED APPLICATION

This application claims priority to provisional patent application U.S. Ser. No. 61/881,768 filed on Sep. 24, 2013, the entire contents of which is herein incorporated by reference.

BACKGROUND

The embodiments herein relate generally to systems that load .22 and .17 caliber rimfire ammunition into rifles with tubular magazines.

Prior to embodiments of the disclosed invention, when loading a .22 rimfire rifle with a tubular magazine, ammunition was loaded by hand, one shell at a time from a pocket, box or similar container. It was a slow cumbersome process and extremely difficult to do quickly, under adverse conditions, with gloves or because of certain physical ailments. Because of the difficulty and awkwardness of loading by hand ammunition was often dropped and soiled or was lost. As a user ages, the dexterity to perform the loading operation decreases and decreases the ability to perform the task. There was also the risk of loading the ammunition upside down and therefore the possibility of jamming in the rifle's magazine or of accidental discharge. Embodiments of the disclosed invention solve this problem.

SUMMARY

A system can be used for loading cartridges into a firearm having a magazine tube. The system includes a housing that can be configured direct cartridges into the magazine tube. A cartridge carrier is detachably coupled to the housing. The cartridge carrier is configured to receive a plurality of cartridges, which are then dispensed through the housing and into the magazine tube.

In some embodiments, the housing can further comprise a housing shaft, configured to receive the cartridge carrier. A tube guide can be attached to the housing shaft and configured to fit around the magazine tube. A cartridge dispensing hole can be on the tube guide configured to permit movement of a cartridge from the housing shaft into the magazine tube. A housing cartridge stop can be attached to the housing shaft and configured to prevent a cartridge from being pulled out of the housing shaft without falling through the cartridge dispensing hole. A housing side detent arranged on the housing shaft.

In some embodiments, the cartridge carrier can further comprise a cartridge carrier concave end finger grip that can be arranged on a first end of the cartridge carrier. A cartridge carrier recessed edge indent can be arranged on a second end of the cartridge receiver. A plurality of cartridge carrier cartridge slots can be arranged within the cartridge carrier. A cartridge carrier side detent can be arranged on the cartridge carrier.

BRIEF DESCRIPTION OF THE FIGURES

The detailed description of some embodiments of the invention is made below with reference to the accompanying figures, wherein like numerals represent corresponding parts of the figures.

FIG. 10 is a schematic view of an embodiment of the invention (preparation) and a continuation of FIG. 9.

FIG. 11 is a schematic view of an embodiment of the invention (loading firearm).

DETAILED DESCRIPTION OF CERTAIN EMBODIMENTS

Figure 1:
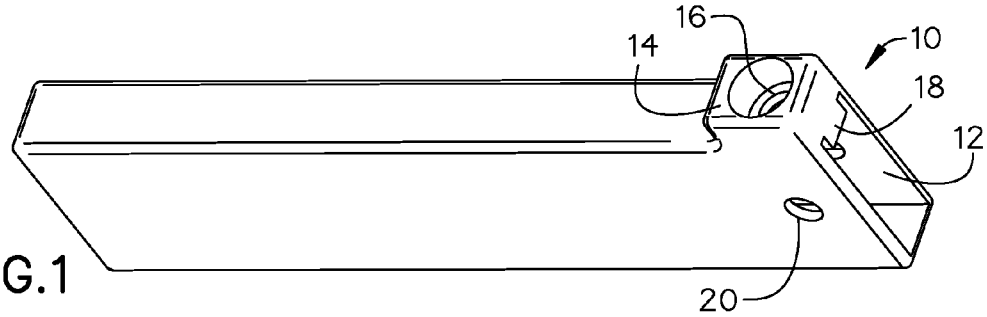
FIG. 1 is a perspective view of an embodiment of the housing.

By way of example, and referring to FIG. 1, one embodiment of the system comprises housing 10, which is configured to receive cartridge carrier 30.

Figure 2:
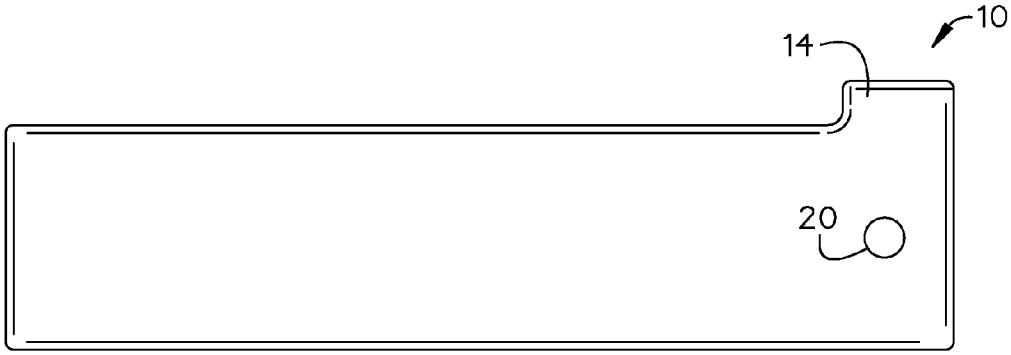
FIG. 2 is a side view of an embodiment of the housing.
Figure 3:
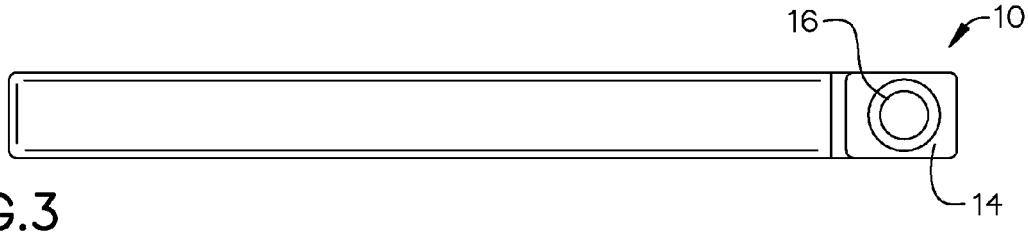
FIG. 3 is a top view of an embodiment of the housing.
Figure 4:
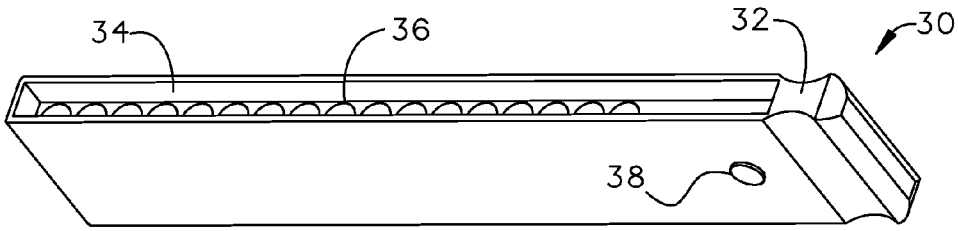
FIG. 4 is a perspective view of an embodiment of the cartridge carrier.

As shown in FIG. 1, FIG. 2 and FIG. 3, housing 10 is generally parallelepiped in shape except for a first end. The first end further comprises an opening to housing shaft 12. Housing shaft 12 is mechanically coupled to tube guide 14. Tube guide 14 further comprises cartridge dispensing hole 16 and is mechanically coupled to housing cartridge stop 18. Housing shaft 12 is perforated with housing receiver for housing side detent 20.

Figure 6:
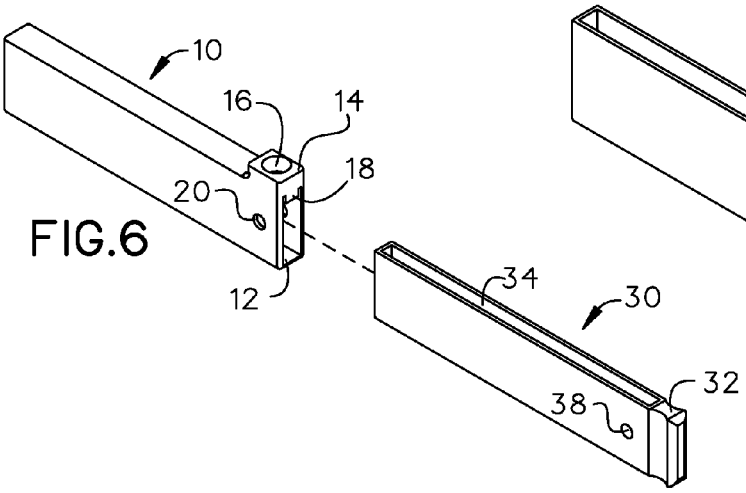
FIG. 6 is an exploded view demonstrating insertion of cartridge carrier into housing.
Figure 5:
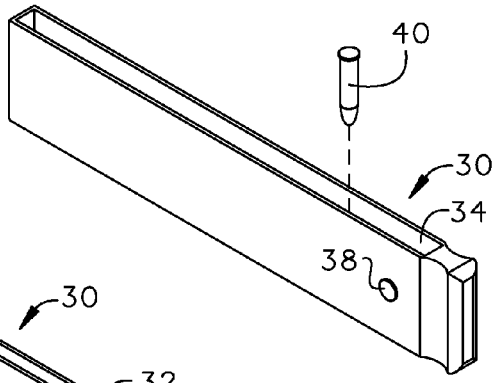
FIG. 5 is an exploded view demonstrating inserting of rim-fire cartridge into cartridge carrier.
Figure 7:
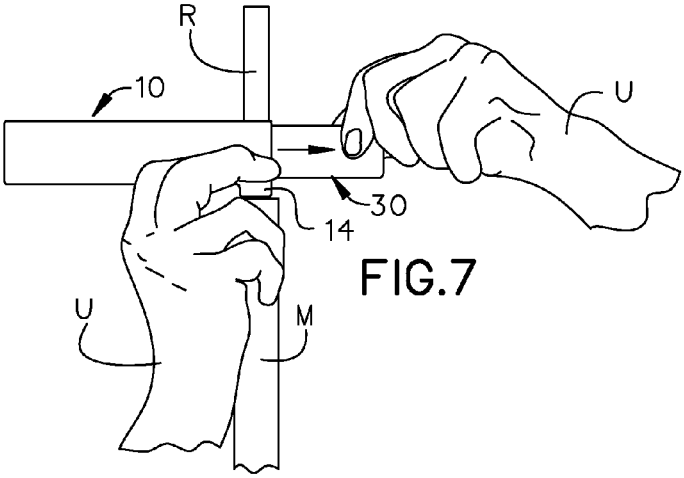
FIG. 7 is a perspective view demonstrating usage.
Figure 8:
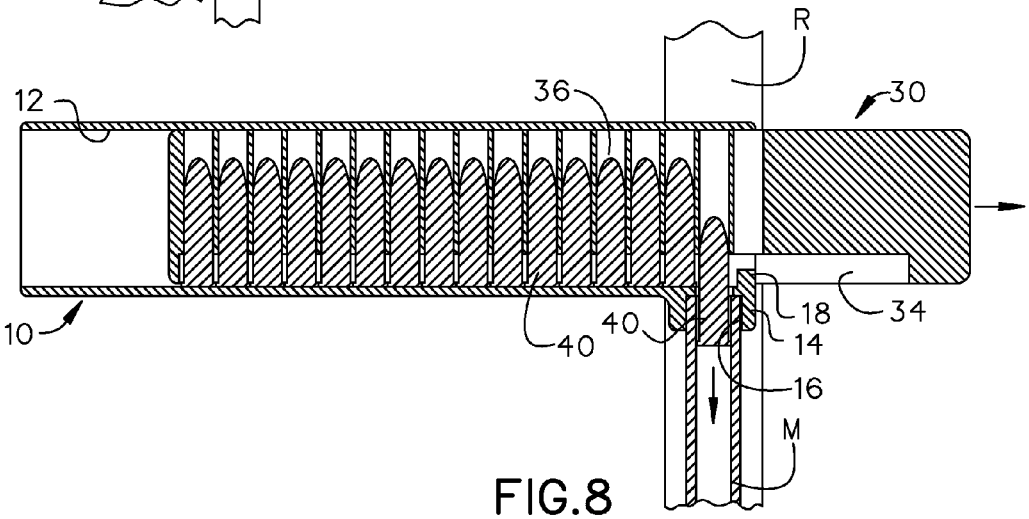
FIG. 8 is a section view of FIG. 7.
Figure 9:
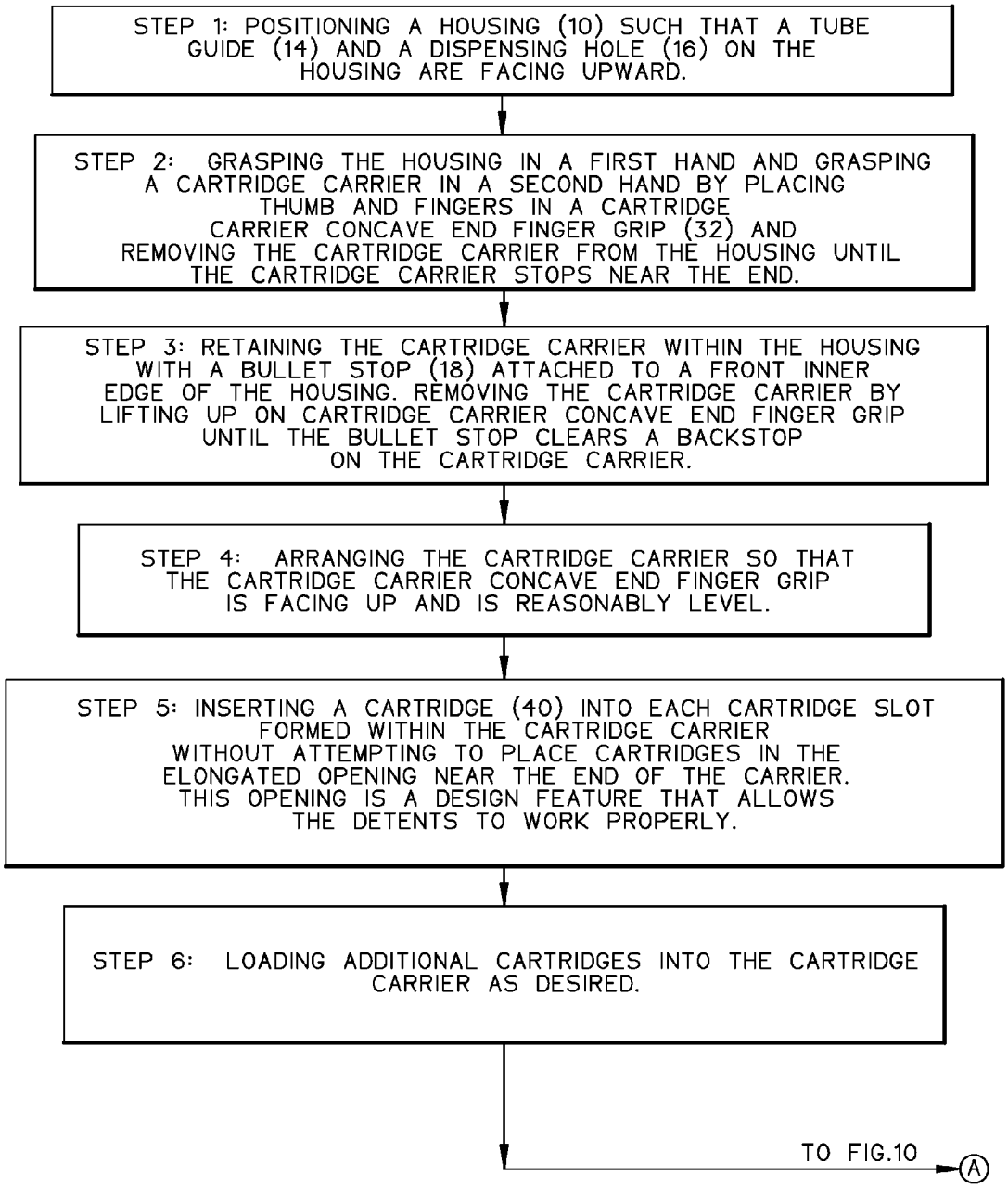
FIG. 9 is a schematic view of an embodiment of the invention (preparation).
Figure 12:
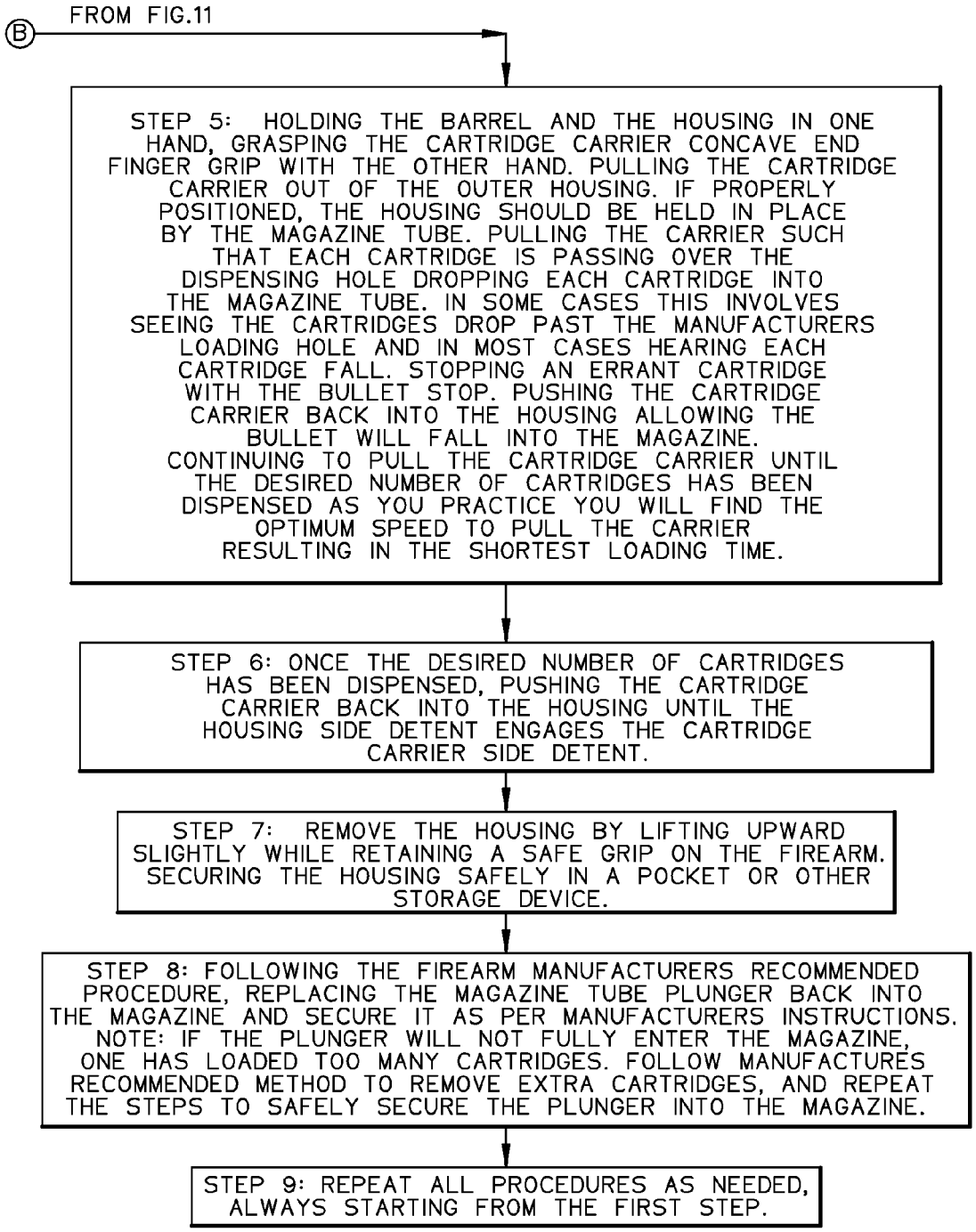
FIG. 12 is a schematic view of an embodiment of the invention (loading firearm) and a continuation of FIG. 11.

FIG. 5 and FIG. 6 show cartridge carrier 30. Cartridge carrier 30 is generally parallelepiped in shape except for a first end and a second end. Cartridge carrier 30 further comprises cartridge carrier concave end finger grip 32 on the first end and cartridge carrier recessed edge indent 34 on the second end. Cartridge carrier 30 is mechanically coupled to a plurality of cartridge carrier cartridge slots 36. Cartridge carrier 30 is further mechanically coupled to cartridge carrier side detent 38. One cartridge 40 is inserted into each cartridge slot 36.

FIG. 5, FIG. 6, FIG. 7 and FIG. 8 show how user U can insert cartridge 40 from cartridge carrier 30 into magazine M on rifle R. This process is explained in more detail in FIG. 11, FIG. 12, FIG. 13 and FIG. 14.

A process for loading cartridge 40 into cartridge carrier 30 and then into housing 10 comprises the following steps, which are not necessarily in order. First, positioning housing such that a tube guide and a dispensing hole are facing upward. Next, grasping housing 10 in a first hand and grasp cartridge carrier 30 in a second hand by placing thumb and fingers in a cartridge carrier concave end finger grip 32 and removing cartridge carrier 30 from the housing 10 until cartridge carrier 30 stops near the end of housing 10. After that, retaining cartridge carrier 30 within housing 10 with housing cartridge stop 18 attached to a front inner edge of housing 10. Then, removing the cartridge carrier 30 by lifting up on cartridge carrier concave end finger grip 32 until housing cartridge stop 18 clears a backstop on the cartridge carrier.

Following that, arranging cartridge carrier 30 so that the cartridge carrier recessed cartridge slots 34 is facing up and is reasonably level. Next, inserting a cartridge 40 into each cartridge slot 36 formed within cartridge carrier 30. It is advisable to not attempt to place cartridges 40 in an elongated opening near the end of cartridge carrier 30. This opening is a design feature that allows housing side detent 20 and cartridge carrier side detent 38 to work properly.

After that, loading additional cartridges 40 into cartridge carrier 30 as desired. Then, inserting cartridge carrier 30 into housing 10, by holding one component in each hand, positioning housing 10 so that the dispensing hole 16 and the tube guide 14 is both facing upward and facing toward cartridge carrier 30. Next, positioning cartridge carrier 30 so that cartridge slots 36 are visible and facing upwards and cartridge carrier concave end finger grip 32 is away from housing 10.

Following that, tilting cartridge carrier 30 with the cartridge carrier concave end finger grip 32 slightly higher than the cartridge slots 36. In some embodiments this may be approximately 30 degrees measured from the lower edge of cartridge carrier 30. After that, placing the top edge of cartridge carrier 30 behind housing cartridge stop 18. Next, leveling the two components and continuing to slide cartridge carrier 30 into the housing 10 until cartridge carrier side detent 38 clicks into place in housing side detent 20 in housing 10. Housing cartridge stop 18 will also act to prohibit cartridge carrier 30 from being inserted too far into housing 10.

A process for loading a plurality of cartridges 40 into a magazine tube M in rifle R includes the following steps, which are not necessarily in order. First, reading the firearm owner's manual for proper safety education and following all safety rules for loading a particular firearm. Next, removing a tubular magazine plunger tube from magazine M on the firearm and storing the plunger tube. Then, positioning housing 10 so that dispensing hole 16 and the tube guide 14 are directly over an open end of magazine tube M.

After that, aligning dispensing hole 16 with the opening of the magazine tube M by placing the tube guide 14 over magazine tube M and ensuring magazine tube M is fully inserted into the tube guide 14. At this point, housing 10 should be perpendicular to the barrel of the rifle R. Following that, holding the barrel and the housing in one hand, grasping the cartridge carrier concave end finger grip with the other hand. Next, pulling cartridge carrier 30 out of housing 10. If properly positioned, housing 10 should be held in place by the magazine tube M.

Then, pulling cartridge carrier 30 such that each cartridge 40 is passing over dispensing hole 16. After that, dropping each cartridge 40 into magazine tube M. In some cases this involves seeing cartridges 40 drop past the manufacturers loading hole and in most cases this involves hearing each cartridge 40 fall into magazine tube M. In some embodiments, there is a step of stopping an errant cartridge 40 with the housing cartridge stop 18. Then, pushing cartridge carrier 30 back into housing 10 allowing the errant cartridge 40 will fall into magazine tube M. Next, continuing to pull cartridge carrier 30 until the desired number of cartridges 40 have been dispensed. Experimentation can result in an optimum speed to pull cartridge carrier 30 resulting in the shortest loading time.

Following that, pushing cartridge carrier 30 back into housing 10 until the housing side detent 20 engage the cartridge carrier side detent 38. Next, remove housing 10 by lifting upward slightly while retaining a safe grip on the firearm. After that, securing the housing safely in a pocket or other storage device. Finally, replacing the plunger as explained by the firearm manufacturer.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system for loading cartridges into a firearm having a magazine tube, the system comprising:

a housing, configured to direct cartridges into the magazine tube;

a cartridge carrier, detachably coupled to the housing;

wherein the cartridge carrier is configured to receive a plurality of cartridges which are then dispensed through the housing and into the magazine tube;

wherein the housing further comprises a housing shaft, configured to receive the cartridge carrier; a tube guide, attached to the housing shaft and configured to fit around the magazine tube;

a cartridge dispensing hole, on the tube guide configured to permit movement of a cartridge from the housing into the magazine tube;

a housing cartridge stop, attached to the housing shaft and configured to prevent a cartridge from being pulled by the carrier out of the housing shaft without falling through the cartridge dispensing hole; and a housing side detent arranged on the housing shaft.

2. The system of claim 1, wherein the cartridge carrier further comprises:

a cartridge carrier concave end finger grip, arranged on a first end of the cartridge carrier;

a cartridge carrier recessed edge indent, arranged on a second end of the cartridge receiver;

a plurality of cartridge carrier cartridge slots arranged within the cartridge carrier; and a cartridge carrier side detent arranged on the cartridge carrier.

3. A process for loading a plurality of cartridges into a firearm having a magazine tube, the process comprising:

loading the plurality of cartridges into a cartridge carrier;

loading the cartridge carrier into a housing;

wherein the housing further comprises a housing shaft, configured to receive the cartridge carrier; a tube guide, attached to the housing shaft and configured to fit around the magazine tube;

a cartridge dispensing hole, on the tube guide configured to permit movement of a cartridge from the housing into the magazine tube;

a housing cartridge stop, attached to the housing shaft and configured to prevent a cartridge from being pulled by the carrier out of the housing shaft without falling through the cartridge dispensing hole; and a housing side detent arranged on the housing shaft;

and dispensing the plurality of cartridges from the cartridge carrier into the magazine tube.

4. The process of claim 3, wherein dispensing the plurality of cartridges from the cartridge carrier into the magazine tube further comprises positioning the housing so that a dispensing hole and a tube guide on the housing are directly over an open end of magazine tube.

5. The process of claim 4, further comprising: stopping an errant cartridge with a housing cartridge stop attached to the housing.

* * * * *